US006145457A

United States Patent [19]

Imaeda et al.

[11] Patent Number: 6,145,457

[45] Date of Patent: Nov. 14, 2000

[54] SEWING MACHINE HAVING NEEDLE BAR OSCILLATING MECHANISM, NEEDLE BAR INTERRUPTING MECHANISM AND THREAD TENSION RELEASING MECHANISM

[75] Inventors: Toru Imaeda, Ichinomiya; Yasuhiro Watanabe, Tokoname, both of Japan

[73] Assignee: Brother Kogyo Kabushiki Kaisha, Nagoya, Japan

[21] Appl. No.: 09/484,019

[22] Filed: Jan. 18, 2000

[30] Foreign Application Priority Data

Jan. 18, 1999 [JP] Japan ..... 11-009463

[51] Int. Cl.[7] ..... D05B 3/02; D05B 69/22

[52] U.S. Cl. ..... 112/459; 112/221

[58] Field of Search ..... 112/157, 459, 112/443, 448, 462, 464, 221, 255, 254

[56] References Cited

U.S. PATENT DOCUMENTS

| | | | |
|---|---|---|---|
| 3,433,190 | 3/1969 | Sagi | 112/221 X |
| 3,872,809 | 3/1975 | Adams et al. | 112/221 |
| 4,254,721 | 3/1981 | Teetz et al. | 112/221 |
| 4,289,086 | 9/1981 | Bolldorf et al. | 112/221 |
| 4,619,214 | 10/1986 | Baruffa et al. . | |
| 5,507,239 | 4/1996 | Fujii et al. | 112/221 ZR |
| 6,055,920 | 5/2000 | Hori | 112/443 |

FOREIGN PATENT DOCUMENTS 2-36455 10/1990 Japan .

*Primary Examiner*—Ismael Izaguirre
*Attorney, Agent, or Firm*—Oliff & Berridge, PLC

[57] ABSTRACT

A sewing machine has a needle bar up/down moving mechanism, a needle bar oscillating mechanism, a needle bar interrupting mechanism, a thread tension adjusting mechanism, and a thread tension releasing mechanism. The sewing machine further includes a driving mechanism that transmits a driving force of an electric motor to the needle bar oscillating mechanism, the needle bar interrupting mechanism and the thread tension releasing mechanism. The driving mechanism comprises a first cam and a second cam which are driven by the electric motor. The first cam has an oscillating cam face that controls the needle bar oscillating mechanism and an interrupting cam face that controls the needle bar interrupting mechanism. The second cam has a releasing cam face that controls a thread tension releasing mechanism. Therefore, the needle bar oscillating mechanism, the needle bar interrupting mechanism and the thread tension releasing mechanism can be driven by a common electric motor.

20 Claims, 16 Drawing Sheets

SEWING MACHINE HAVING NEEDLE BAR OSCILLATING MECHANISM, NEEDLE BAR INTERRUPTING MECHANISM AND THREAD TENSION RELEASING MECHANISM

BACKGROUND OF THE INVENTION

1. Field of Invention

The invention relates to a sewing machine having a needle bar up/down moving mechanism, a needle bar oscillating mechanism, a needle bar interrupting mechanism that interrupts the needle bar up/down moving mechanism from moving the needle bar up and down, a thread tension adjusting mechanism, and a thread tension releasing mechanism and, in particular, to a sewing machine where the needle bar oscillating mechanism, the needle bar interrupting mechanism, and the thread tension releasing mechanism are driven by a common actuator.

2. Description of Related Art

Conventionally, a zigzag sewing machine capable of sewing straight and zigzag patterns, includes a plurality of sewing devices, such as a thread tension adjusting mechanism that adjusts a tension of a needle thread by sandwiching the needle thread between a pair of thread tension disks, a needle bar up/down moving mechanism that moves the needle bar up and down, and a needle bar oscillating mechanism that oscillates the needle bar in a direction perpendicular to a feeding direction of a work cloth. This kind of zigzag sewing machine optionally includes a needle bar interrupting mechanism, that interrupts the needle bar up/down moving mechanism from moving the needle bar up and down, and a tension releasing mechanism, that allows the thread tension mechanism to release the needle thread tension, which work in the case where the needle bar is temporarily stopped for making an extreme long stitch, such as basting, or the upper and lower threads are automatically cut by the thread trimming mechanism in the middle of or at the end of sewing.

In this case, the needle bar up/down moving mechanism is driven because a main shaft is rotated by a machine motor, and the needle bar is oscillated via the needle bar oscillating mechanism driven by an exclusive electric motor. The needle bar interrupting mechanism is independently driven by an electric actuator, such as a solenoid, which is exclusively provided. The tension releasing mechanism is also independently driven by an electric actuator, such as a solenoid, which is also exclusively provided. Namely, the needle bar oscillating mechanism, the needle bar interrupting mechanism, and the tension releasing mechanism are separately driven by an exclusive motor or electric actuator. The problems are the cost of manufacturing becomes higher and the assembly operation becomes complicated because electric motors and actuators are attached to a machine, which further result in a larger size of the sewing machine.

As a result, recently proposed sewing machines have fewer electric actuators because a plurality of mechanisms, such as the needle bar oscillating mechanism and the needle bar interrupting mechanism, are driven by one actuator.

For example, in the needle bar disengaging mechanism of a zigzag sewing machine disclosed in Japanese Utility Model Publication No. 2-36455, the needle bar is oscillated via an oscillating rod when a zigzag pulse motor is driven within a specified rotating angle. On the other hand, when the pulse motor is driven more than the specified rotating angle, a disengaging link is rotated, and a disengaging clutch plate is activated to release the coupling of the needle bar driving mechanism. Then, finally, the needle bar is disengaged.

In the machine disclosed in U.S. Pat. No. 4,619,214, the head includes a servomotor and a cam having two laterally presented faces B, C and ramp A1, A2, A3, which is driven by the servomotor. When the servomotor drives the cam, the two faces B, C make contact with a pair of feelers to oscillate the needle bar. Simultaneously, a feeler makes contact with ramp A1, A2, A3 to interrupt the needle bar from moving up and down.

In the needle bar disengaging mechanism of the zigzag sewing machine in Japanese Utility Model Publication No. 2-36455 and the sewing machine in U.S. Pat. No. 4,619,214, the needle bar oscillating mechanism and the needle bar interrupting mechanism are driven by the combination of an electric motor and a cam, in order to decrease the number of actuators. When the tension releasing mechanism, that allows the thread tension mechanism to release the needle thread so as to automatically pay it out for thread trimming, is provided, an electric actuator to drive the tension releasing mechanism is additionally required. Furthermore, a control element is required, such as a high specification CPU that has an additional output port for driving the electric actuator. Therefore, this makes the cost higher and the size of the machine larger.

SUMMARY OF THE INVENTION

The invention was made in consideration of the above circumstances. Therefore, the objects of the invention are to activate each of the needle bar oscillating mechanism, the needle bar interrupting mechanism, and the tension releasing mechanism by one actuator; and to design a smaller version of the actuator by dispersing the load on the actuator in action, leading to a smaller version of the sewing machine and cost reductions.

To accomplish these objects, a sewing machine, described in the embodiments of the invention, comprises a needle bar having a lower end to which a needle with an eye is attached, a needle bar up/down moving mechanism that moves a needle bar up and down, a needle bar oscillating mechanism that oscillates the needle bar in a lateral direction perpendicular to a feeding direction of a work cloth, a needle bar interrupting mechanism that interrupts the needle bar up/down moving mechanism from moving the needle bar up and down, a needle thread supply source that supplies a needle thread, a thread tension adjusting mechanism that adjusts a tension of the needle thread in a path extending from the needle thread supplying source to the eye of the needle, a tension releasing mechanism that allows the thread tension mechanism to release the tension of the needle thread, an actuator that gives a driving force, and a driving mechanism that transmits the driving force of the actuator to the needle bar oscillating mechanism, the needle bar interrupting mechanism, and the tension releasing mechanism.

Therefore, the needle bar is oscillated in a lateral direction perpendicular to a feeding direction of a work cloth via the needle bar oscillating mechanism, its vertical movement is interrupted via the needle bar interrupting mechanism, and the thread tension adjusting mechanism is allowed to release the tension of the needle thread via the tension releasing mechanism. The needle bar oscillating mechanism, the needle bar interrupting mechanism, and the thread tension releasing mechanism are capable of working by one common actuator via the driving mechanism. When the actuator is driven, the needle bar oscillating mechanism oscillates the needle bar to form zigzag stitches. At thread trimming, the needle bar interrupting mechanism and the tension releasing mechanism are driven to pay out the needle thread, so as not to lose it from the eye of the needle.

In a preferred aspect of the invention, the actuator comprises an electric motor. Therefore, the structure of the driving mechanism can be simplified.

In another preferred aspect of the invention, the electric motor comprises a stepping motor. Because the electric motor can be driven by open-loop control system, the driving mechanism accuracy will be improved, the electric motor can be developed into a small version, and its costs will be reduced.

In a further preferred aspect of the invention, the driving mechanism comprises a first cam that controls the needle bar oscillating mechanism and the needle bar interrupting mechanism, and a second cam that controls the tension releasing mechanism, wherein the first and second cams are rotationally driven by the electric motor. Because the needle bar oscillating mechanism and the needle bar interrupting mechanism are controlled by the first cam only, the number of parts is reduced, assembly operations are simplified, and no timing adjustment between the mechanisms is needed. As the first cam and the second cam are independent parts, the flexibility to position the electric motor is greatly improved. In the embodiment, for example, the first cam is disposed at an optimum position close to the needle bar oscillating mechanism and the needle bar interrupting mechanism, and the second cam is also disposed at an optimum position close to the tension releasing mechanism.

In another preferred aspect of the invention, the first cam is pivotally mounted to a first pivot pin, which is parallel with the feeding direction of the work cloth and is disposed on a lower position relative to the driving shaft connected to the electric motor, and the second cam is pivotally mounted to a second pivot pin, which is parallel with the feeding direction of the work cloth and is disposed on an upper position relative to the driving shaft connected to the electric motor.

Namely, the first pivot pin, that pivotally supports the first cam, and the second pivot pin, that pivotally supports the second cam, are disposed in parallel with the driving shaft connected to the electric motor. Therefore, the driving mechanism comprising the first and second cams is simplified by the electric motor. Because the first pivot pin is disposed at a lower position relative to the driving shaft and the second pivot pin is disposed at an upper position relative to the driving shaft, the head portion of sewing machine can be downsized.

In a further preferred aspect of the invention, the first cam has an oscillating cam face that controls the needle bar oscillating mechanism and an interrupting cam face that controls the needle bar interrupting mechanism, and the second cam has a tension releasing cam face that controls the tension releasing mechanism.

In another preferred aspect of the invention, the oscillating cam face, the tension releasing cam face, and the interrupting cam face are arranged based on the phase angle of the stepping motor, so that a needle bar oscillating range where the needle bar can be oscillated under control of the oscillating cam face, a tension releasing range where the tension of the needle thread is released under control of the tension releasing cam face, and a needle bar interrupting range, where the needle bar up/down moving mechanism is interrupted from moving the needle bar up and down under control of the interrupting cam face, are set in series.

When the stepping motor is intended to be initialized at the phase angle 0°, the needle bar oscillating range (e.g., 30°–240°), the needle thread tension releasing range (e.g., 240°–345°), and the interrupting range (e.g., 345°–405°) are set in series. Therefore, the needle bar oscillation, the thread tension release, and the needle bar interruption can work separately without causing interference. Further, the load on the stepping motor is dispersed, resulting in a smaller version of the stepping motor.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

One preferred embodiment of the invention will be described in detail with reference to the accompanying drawings.

This embodiment of the invention is an example of the invention being applied to a lock stitch sewing machine having a needle bar up/down moving mechanism and a needle bar oscillating mechanism.

Figure 1:
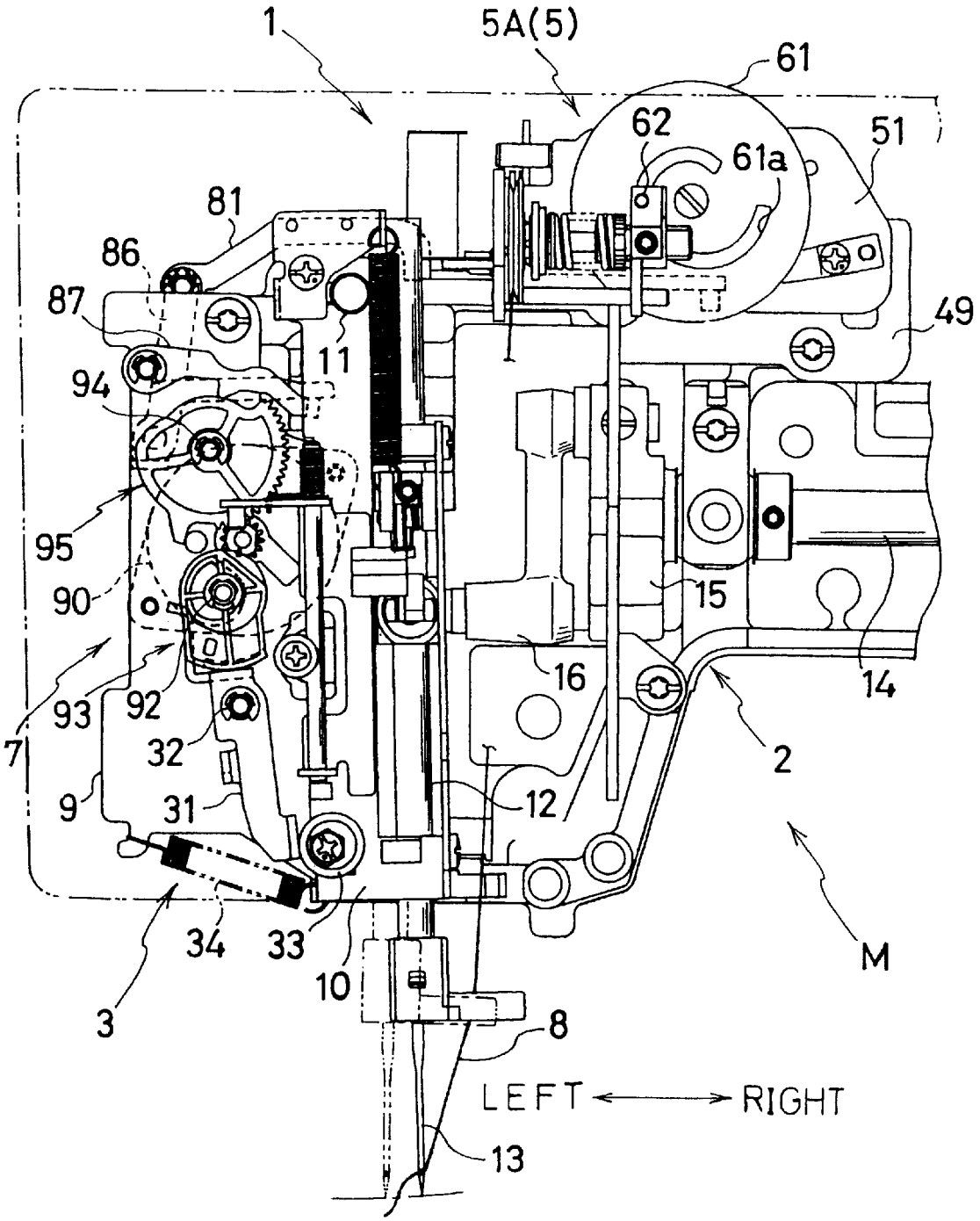
FIG. 1 is a front elevation of a part of a head of a lock stitch sewing machine of the invention.

FIG. 1 shows a machine head 1 of a lock stitch sewing machine M. The head 1 includes a needle bar up/down moving mechanism 2 that drives a needle bar 12 up and down, a needle bar oscillating mechanism 3 that oscillates the needle bar 12 in a direction perpendicular to a feeding direction of a work cloth, a needle bar interrupting mechanism 4 (FIG. 4) that interrupts the needle bar 12 from moving up and down, a thread tension adjusting mechanism 5 that adjusts a tension of a needle thread 8 passed from a spool (not shown) to an eye of a needle 13 attached to the bottom of the needle bar 12, a tension releasing mechanism 6 (FIG. 3) that allows the thread tension mechanism 5 to release the tension of the needle thread 8, and a driving mechanism 7 that drives the needle bar oscillating mechanism 3, the needle bar interrupting mechanism 4, and the tension releasing mechanism 6 by a driving force of an electric motor 90.

The needle bar up/down moving mechanism 2 will be now described using FIGS. 1–5.

A needle bar base 10 is disposed in a central part of the head 1. The needle bar base 10 is pivotally mounted on a pedestal Fa (FIG. 3), which is extended frontward from a frame F, using a pivot pin 11 at the top. The needle bar base 10 supports the needle bar 12 therein so that it can move vertically, and a needle 13 is detachably attached to the bottom of the needle bar 12. A thread take-up crank 15 is fixed to an end of a machine main shaft 14 that is driven by a machine motor (not shown). An upper part of a needle bar connecting rod 16 is pivotally linked to one end of the thread take-up crank 15. The needle bar 12 is linked to a needle bar connecting stud 17 and a link mechanism 18 which are coupled to the needle bar connecting rod 16, so as to move vertically.

The link mechanism 18 will now be briefly explained. The needle bar connecting stud 17 is slidably supported by the needle bar 12. A top end of an oscillating member 20, which is placed vertically, is pivotally mounted on a fixing member 19 fixed to the needle bar 12. An engaging protrusion 20*a* at the bottom of the oscillating member 20 is elastically urged by a coil spring 21 so that the engaging protrusion 20*a* can be engaged with an engaging recess 17*a* of the needle bar connecting stud 17. When the machine motor drives the main shaft 14, the needle bar connecting stud 17 is verticaly slid on the needle bar 12 via the thread take-up crank 15 and the needle bar connecting rod 16, which results in causing the needle bar 12 to move up and down via the link mechanism 18.

The needle bar oscillating mechanism 3 will now be explained with reference to FIGS. 1–6.

A rocking lever 31 is vertically disposed on the left of the needle bar base 10. The rocking lever 31 is pivotally mounted to an auxiliary frame 9 via a pivot pin 32 in the middle portion of the rocking lever 31 in the lengthwise direction. The pivot pin 32 is horizontally disposed in a backward and frontward direction. The lower end of the rocking lever 31 makes contact with an engaging ring 33, which is fixed to the bottom of the needle bar base 10 (at the left in FIG. 1). The upper end of the rocking lever 31 makes contact with an oscillating cam face 93*a* of a first cam 93, which will be later described.

By a force of a tensile coil spring 34 that extends between the auxiliary frame 9 and the needle bar base 10 at their lower parts, the upper end of the rocking lever 31 presses on the oscillating cam face 93*a*, and the bottom of the rocking lever 31 presses on the engaging ring 33. When the first cam 93 turns clockwise or counterclockwise viewed from the front, the needle bar base 10 oscillates around the pivot pin 32 since the rocking lever 31 oscillates in accordance with an eccentric cam face of the oscillating cam face 93*a*. Namely, the needle bar 12 is intended to be oscillated in sync with the oscillation of the needle bar base 10.

The needle bar interrupting mechanism 4 will now be described.

A shaft 40 is pivotally supported in the lower left part of the needle bar base 10. The shaft 40 pivotally supports an interruption plate 41 in which an operating plate 42 (FIG. 2) having about the same size as the lower left part of the needle bar base 10, and a driving lever 43 are combined.

An engaging pin 44 is fixed to the end of the driving lever 43, and the pin 44 can make contact with an interrupting cam face 93*b* of the first cam 93, which will be later described, in the rear. The interruption plate 41 is elastically urged to a counterclockwise direction in a plan view by means of a force of a coil spring 45. The operating plate 42 is capable of engaging into the engaging protrusion 20*b* of the oscillating member 20 in the rear. When the first cam 93 is rotated clockwise and the cam face 93*b* moves the engaging pin 44 backward (FIG. 15), the interruption plate 41 is rotated clockwise viewed from the top. Therefore, the engaging protrusion 20*a* of the oscillating member 20 is detached from the engaging recess 17*a* of the needle bar connecting stud 17 by the engaging protrusion 20*b* joined to the operating plate 42. Thus, the needle bar 12 is interrupted from moving up and down (FIG. 16).

Figure 4:
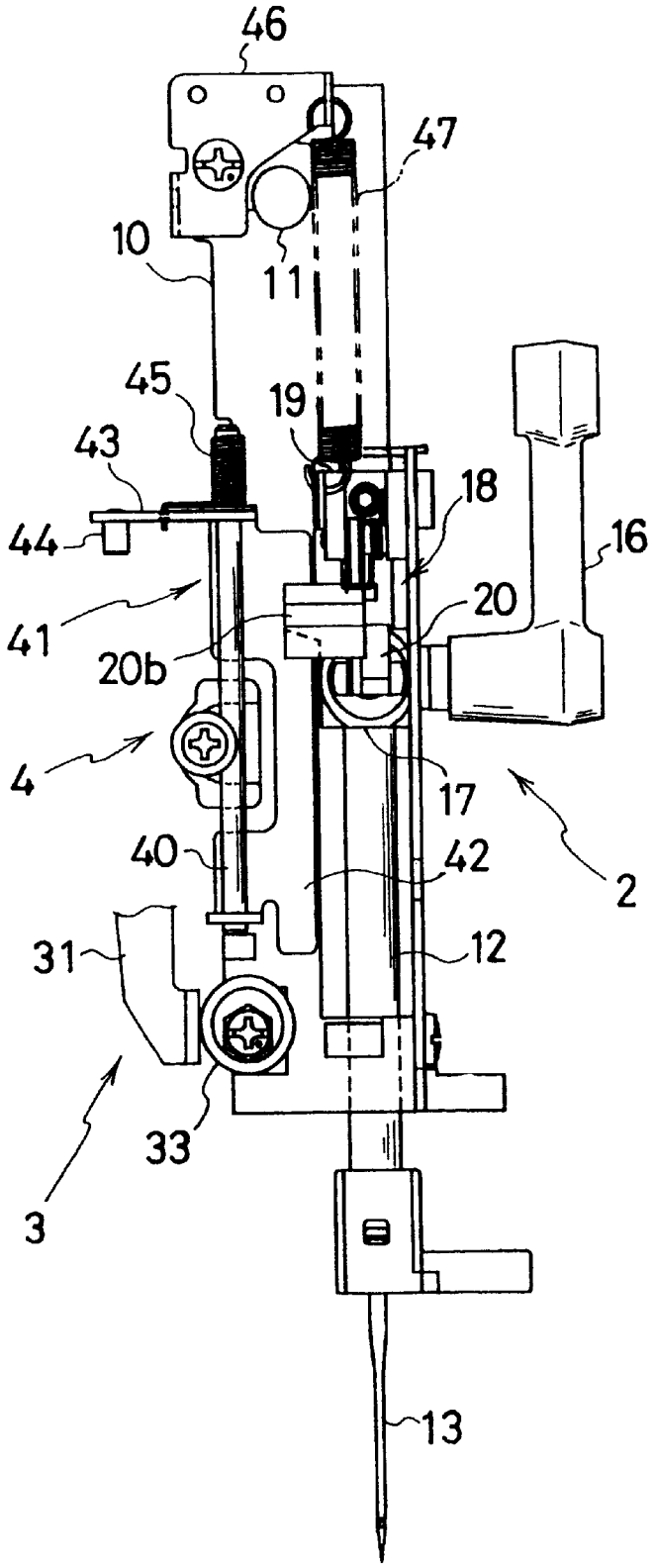
FIG. 4 is a front elevation of a part showing a needle bar up/down moving mechanism and a needle bar oscillating mechanism.
Figure 5:
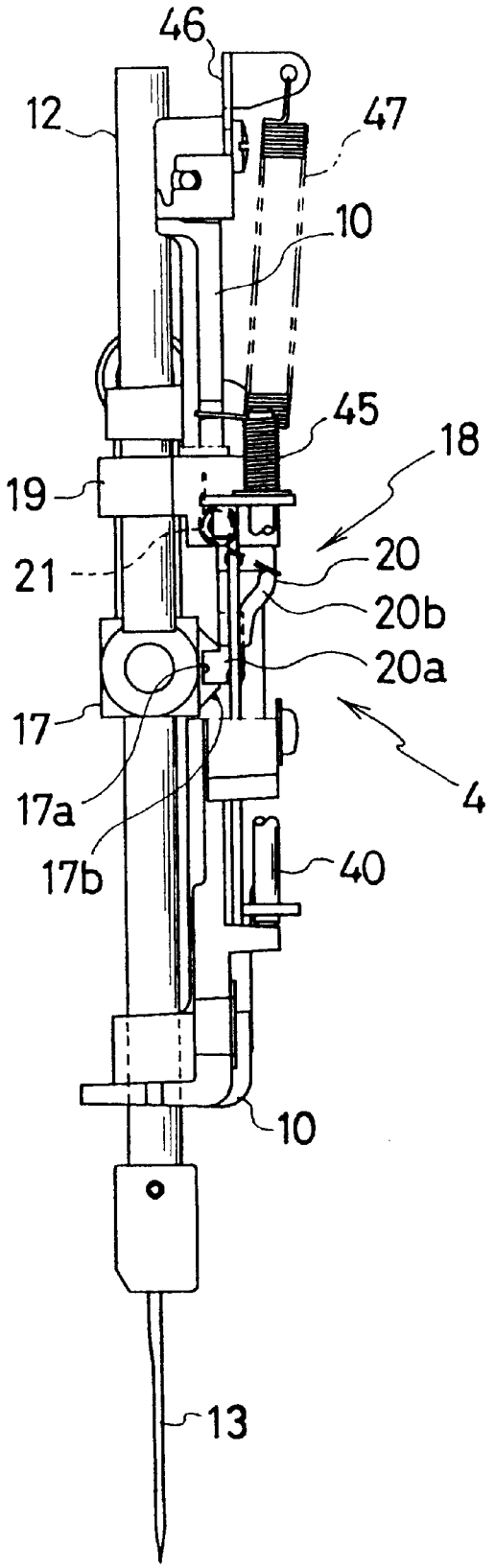
FIG. 5 is a side elevation of the part showing the needle bar up/down moving mechanism and the needle bar oscillating mechanism.
Figure 6:
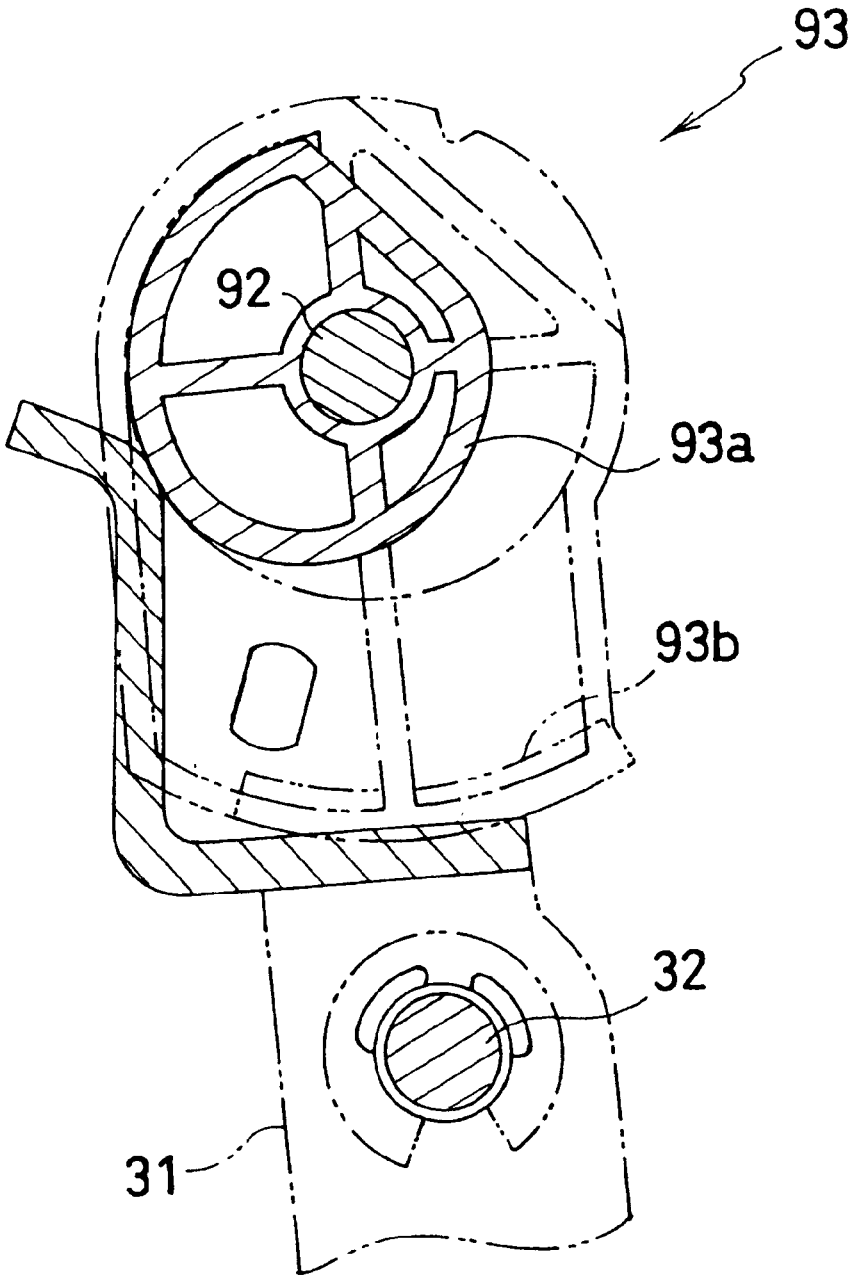
FIG. 6 is a front elevation of a substantial part of a first cam.
Figure 16:
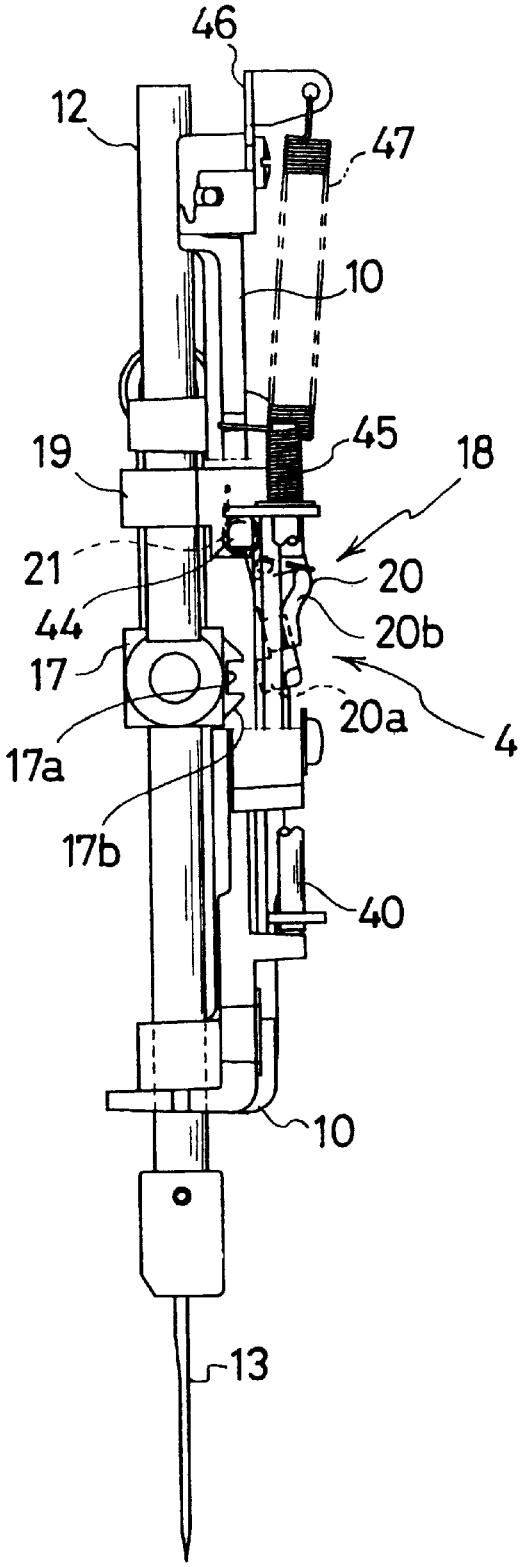
FIG. 16 corresponds to FIG. 5 when the needle bar is interrupted from moving up and down.

Resultantly, the needle bar 12 is slidably moved to its highest position and retained by a force of the extension coil spring 47, which hangs from a spring supporting plate 46 attached to the needle bar base 10 (FIG. 16). After the needle bar 12 has been interrupted in its vertical motion, the interruption plate 41 returns to its stand-by position as indicated in FIGS. 4 and 5, the needle bar connecting stud 17 rises, and the protrusion 20*a* is automatically rengaged into the recess 17*a* via a guide face 17*b*.

Figure 7:
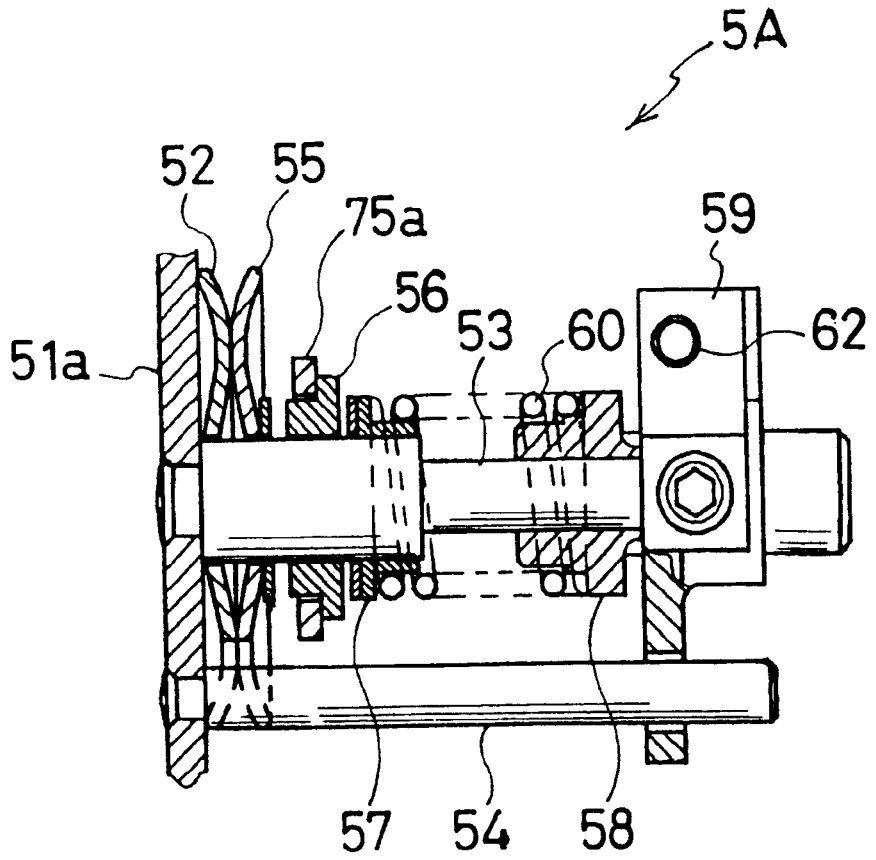
FIG. 7 is a front elevation of a substantial part of a thread tension adjusting mechanism.

The thread tension mechanism 5 will now be described with reference to FIGS. 1, 3, and 7.

The thread tension mechanism 5 has a main tension mechanism 5A and a sub tension mechanism 5B. The main tension mechanism 5A will be described first.

A mounting plate 51 is fixed to the upper part of the front face of a support plate 49 which is disposed in front of the head 1. A fixed thread tension disk 52 is fixed to a mounting portion 51*a*, which is where the left end of the mounting plate 51 is bent forward. Furthermore, a tension stud 53 and an auxiliary shaft 54 are fixed to the mounting portion 51*a* at their left ends (FIG. 7).

On the tension stud 53, the fixed thread tension disk 52, a movable thread tension disk 55 that makes contact with the fixed thread tension disk 52, a step ring 56, ring spring receivers 57, 58, and a tension adjusting member 59 are joined. A compression coil spring 60 is placed between the ring spring receivers 57, 58. A thread tension dial 61, which is disposed just behind the tension stud 53, has a spiral slit 61*a* in which an adjusting pin 62 fixed to the tension adjusting member 59 is inserted. The lower part of the tension adjusting member 59 is slidably mounted to the auxiliary shaft 54 to stop rotating the tension stud 53.

When the tension dial 61 is manually rotated clockwise, viewed from the front, the tension adjusting member 59 moves to the left via the adjusting pin 62 inserted in the slit 61*a*. The pressing force between tension disks 52 and 55 increases as well as the strength of the compression coil spring 60, therefore, the tension applied to the needle thread 8 that passes between the disks 52 and 55 increases. A contact part 75*a* (FIG. 8) of a first release lever 75 is joined in the shoulder portion of the step ring 56.

Next, the sub tension mechanism 5B will be described. A base plate 65 is fixed on the mounting plate 50 behind the main thread tension mechanism 5A which is horizontally fixed to the upper part of the front of the support plate 49.

The base plate 65 has standing portions 65*a* and 65*b* on each end, where a sub thread tension shaft 66 is inserted and movably supported. A fitting 67, which is almost L-shaped when viewed from the top (FIG. 3), is fixed to the left end of the sub thread tension shaft 66, which is moved rightward via a spring receiver 69 fixed to the sub thread tension shaft 66. A tension adjusting plate 70, which is made of flexible material such as a thin stainless steel plate, is fixed to the base plate 65 in the rear and to the fitting 67 at the front.

Figure 3:
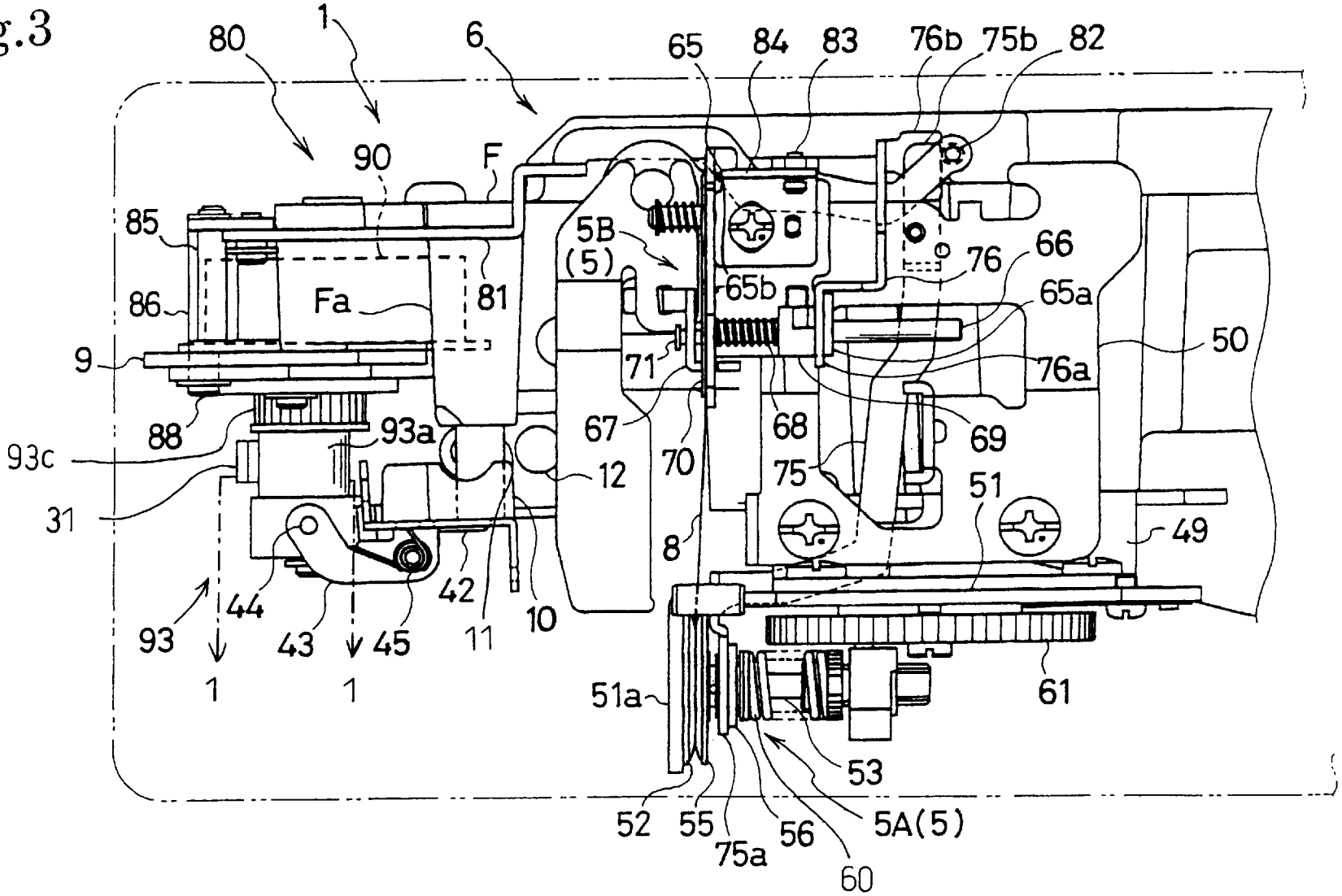
FIG. 3 is a partial top view of the head.

As shown in FIG. 3, the compression coil spring 68 and the sub thread tension stud 66 press the fitting 67 to the right. An adjusting screw 71 attached to the fitting 67 makes the tension adjusting plate 70 push against the base plate 65, which applies a tension to the needle thread 8 that passes between the tension adjusting plate 70 and the base plate 65. A contact part 76*a* of a second release lever 76, which will be described later, is fitted between the standing portion 65*a* of the base plate 65 and the spring receiver 69. The needle thread 8 passes between the tension adjusting plate 70 and the base plate 65 in the sub tension mechanism 5B, further between the fixed disk 52 and the movable disk 55 in the main tension mechanism 5A, and into the eye of the needle 13.

The tension releasing mechanism 6 that makes the mechanisms 5A and 5B release the tension of the needle thread will now be described with reference to FIGS. 1, 3 and 8.

The first release lever 75, which extends in the direction of the depth of the head 1, is disposed under the mounting plate 50. The first release lever 75 has a crank at the front end where the contact part 75*a* is fitted in the stepped portion of the step ring 56. The rear portion of the contact part 75*a* makes contact with the rear of the movable thread tension disk 55. Because the contact part 75*a* is substantially attached to the step ring 56 by a force of the compression coil spring 60, the first release lever 75 is usually positioned as shown in FIG. 3, where the tension is applied to the needle thread.

The second release lever 76 is disposed on the mounting plate 50 substantially in parallel with the first release lever 75. An engaging member 76*b* which is at the rear end of the second release lever 76 is almost in the same position as an engaging member 75*b* of the first release lever 75. The sub thread tension shaft 66 is inserted into a slot 76*c* that is formed in a contact part 76*a* of the second release lever 76. The second release lever 76 is usually positioned between the contact part 76*a* and the spring receiver 69 as shown in FIG. 3, where the tension is applied to the needle thread.

On the other hand, the release levers 75, 76 are oscillated via the link mechanism 80, which make the main tension mechanism 5A and the sub tension mechanism 5B release the tension of the needle thread.

A first lever 81, which extends leftward (FIGS. 3 and 11) when looking at the sewing machine from an operator's position from the engaging members 75*b*, 76*b*, is disposed on the rear end of the mounting plate 50. The first lever 81 is joined to the engaging members 75*b*, 76*b* at an engaging pin 82 provided at the right end, and is supported in the middle by inserting an engaging pin 83 into a slot (not shown) laterally formed in the support fitting 84 provided on the base plate 65.

A second lever 86, which is U-shaped viewed from the side, is pivotally attached to the auxiliary frame 9 by a pivot pin 85. A rear arm 86*a* of the second lever 86 is rotatably connected to the left end of the first lever 81. A third lever 87 (FIG. 1), which is disposed in front of the second lever 86, is rotatably mounted to the frame 9 by a pin 88 at the left end. The end of the front arm 86*b* makes contact with the tip 87*a* of the third lever 87 from above. As shown in FIG. 8, a double chain line indicates the position of the third lever 87 when it is oscillated upward via a contact part 87*b* that makes contact with the cam face 95, which will be later described. After that, the first and second levers 75, 76 are oscillated, resulting in causing the main tension mechanism 5A and the sub tension mechanism 5B to release the tension of the needle thread thereat.

The driving mechanism 7 will now be described with reference to FIGS. 1, 2, 3, and 6.

In the middle of the head in the direction of its height, an electric motor 90, which is comprised of a stepping motor, is disposed. A driving gear 91 is fixed to a driving shaft of the motor 90. Below the driving shaft, a first pivot shaft 92 is fixed to the auxiliary frame 9, and a first cam 93 is pivotally mounted on the shaft 92. The first cam 93 has an oscillating cam face 93*a* having an eccentric portion and an interrupting cam face 93*b* having a backward extending protrusion for interruption of the needle bar vertical movement.

Above the driving shaft in the motor 90, a second pivot shaft 94 is fixed to the auxiliary frame 9, and a second cam 95 is pivotally mounted on the shaft 94. On the circumference of the second cam 95, a non-camming portion 95*a* and a tension releasing cam face 95*b* are formed adjacently. The driving gear 91 engages a gear portion 93*c* of the first cam 93 and a gear portion 95*c* of the second cam 95. The gear ratio between the driving gear 91 and the gear portion 93*c* is 1 to 2, and between the driving gear 91 and the gear portion 95*c* is 1 to 4. A protrusion 95*d* that is a reference mark of the second cam 95 comes into contact with a stop pin 96 that is attached to the auxiliary frame 9.

Figure 2:
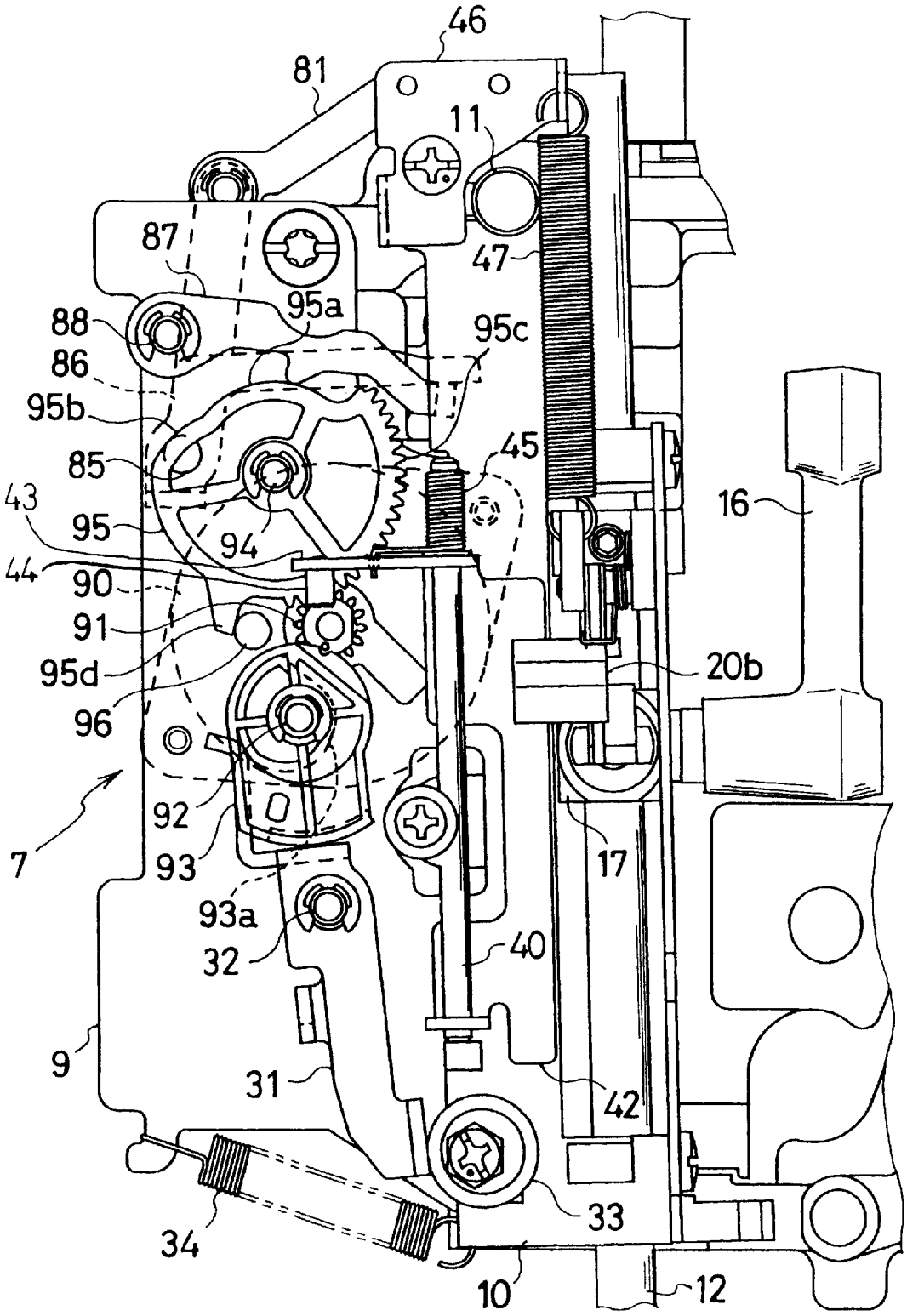
FIG. 2 is an enlarged front elevation of a substantial part of the head.
Figure 9:
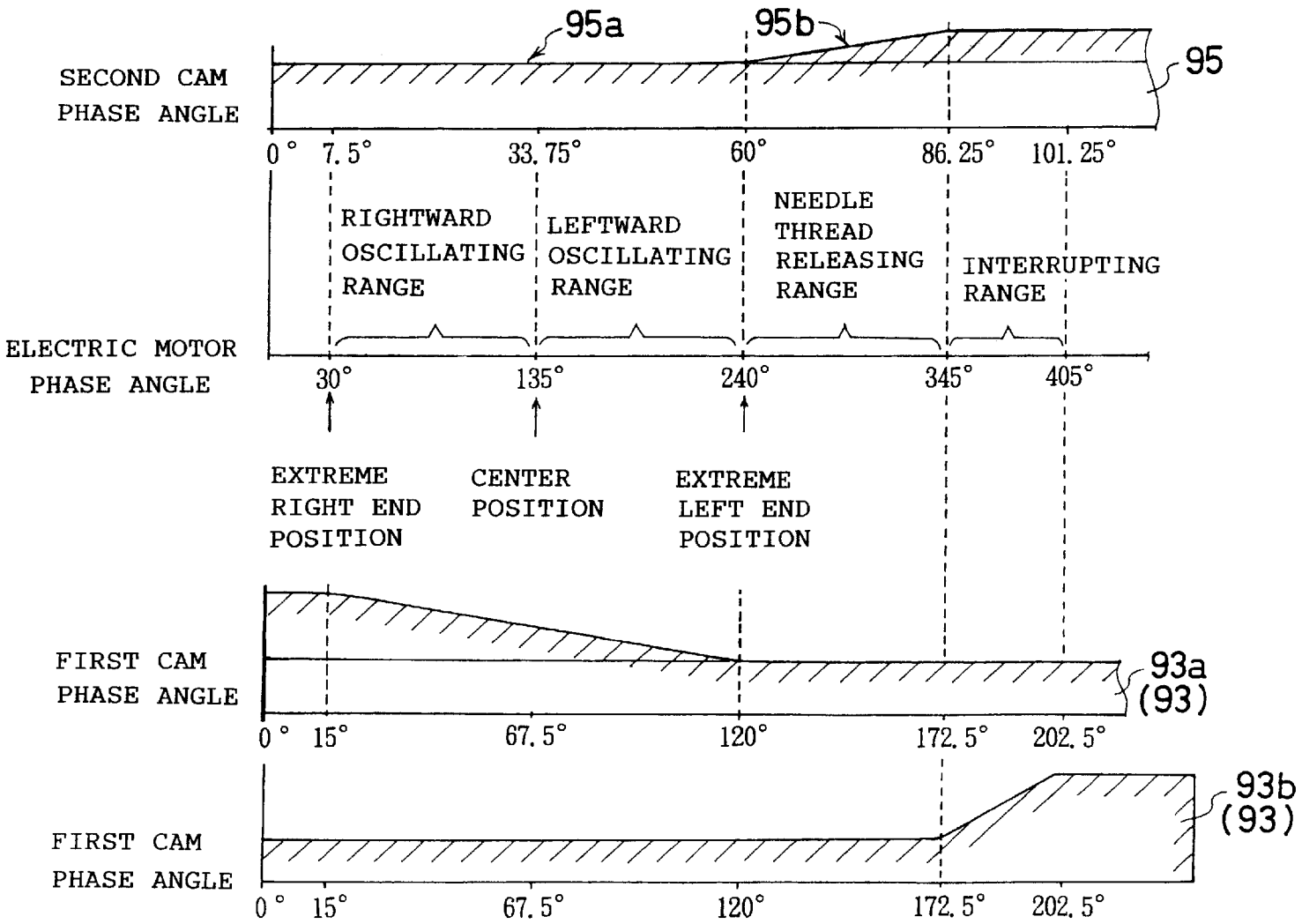
FIG. 9 is a timing chart explaining phase relationship among a tension releasing cam face, an oscillating cam face, and an interrupting cam face based on the phase angle of an electric motor.

The position where the protrusion 95*d* comes into contact with the stop pin 96 is set as the initial state of the motor 90 (FIG. 2). If the phase angle of the motor 90 in the initial state is 0° as shown in FIG. 9, the cam face 93*a* is formed in the range of approx. 15° to 120° of the phase angle on the first cam 93. When the phase angle is approx. 15°, the needle bar is at the extreme right end of its travel. When the phase angle is approx. 67.5°, the needle bar is in the center of its travel. When the phase angle is approx. 120°, the needle bar is at the extreme left end of its travel. The interrupting cam face 93*b* is formed in the range of approx. 172.5° to approx. 202.5° of the phase angle on the first cam 93. Further the tension releasing cam face 95*b* is formed in the range of approx. 60° to approx. 86.25° of the phase angle on the second cam 95.

Thus, beginning at phase 0° of the electric motor 90, a needle bar oscillating range, a tension releasing range and a needle bar interrupting range are arranged in series. The needle bar oscillating range is a range where the needle bar 12 can be oscillated under control of the cam face 93*a*. The needle bar oscillating range comprises a leftward oscillating range and a rightward oscillating range. The tension releasing range is a range where the tension of the needle thread 8 is released under control of the cam face 95*b*. The needle bar interrupting range is a range where the needle bar up/down mechanism 2 is interrupted from moving the needle bar 12 up and down under control of the cam face 93*b*.

Next, the operation of the lock stitch sewing machine M will now be explained.

Figure 10:
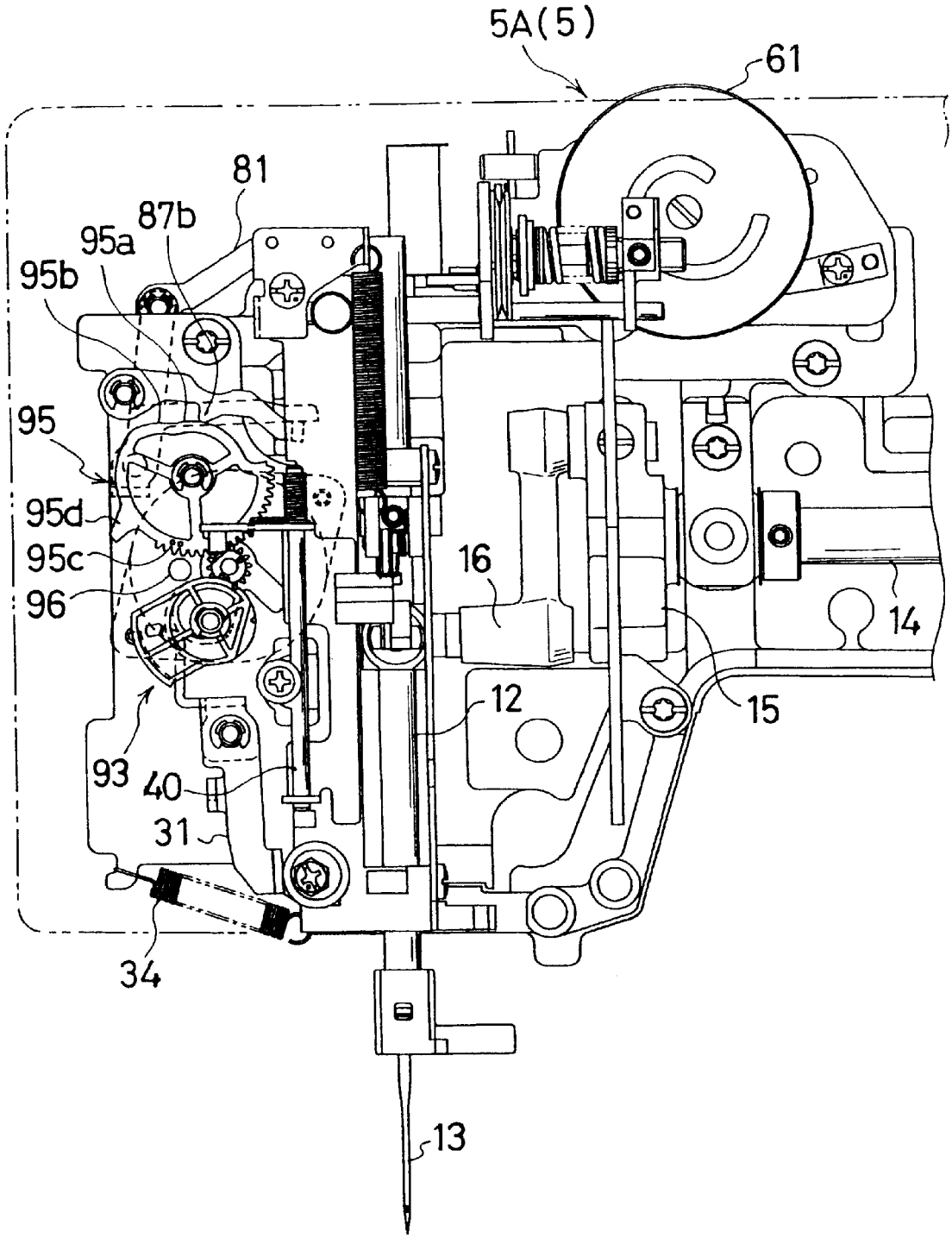
FIG. 10 corresponds to FIG. 1 when the phase angle is 135° at which the needle bar is centered.

Just after the power of the sewing machine M is turned on, the electric motor 90 is driven to reset the machine M to the initial state as shown in FIG. 1, and then the motor 90 is driven and the needle bar is set to the center as shown in FIG. 10 (approx. 135°). At this time, since the contact part 87*b* of the third lever 87 makes contact with the non-camming portion 95*a*, the main and sub thread tension mechanisms 5A and 5B apply tension to the needle thread 8. In addition, the pin 44 of the driving lever 43 does not make contact with the interrupting cam face 93*b*, therefore, the needle bar up/down moving mechanism 2 drives the needle bar 12 up and down.

Figure 11:
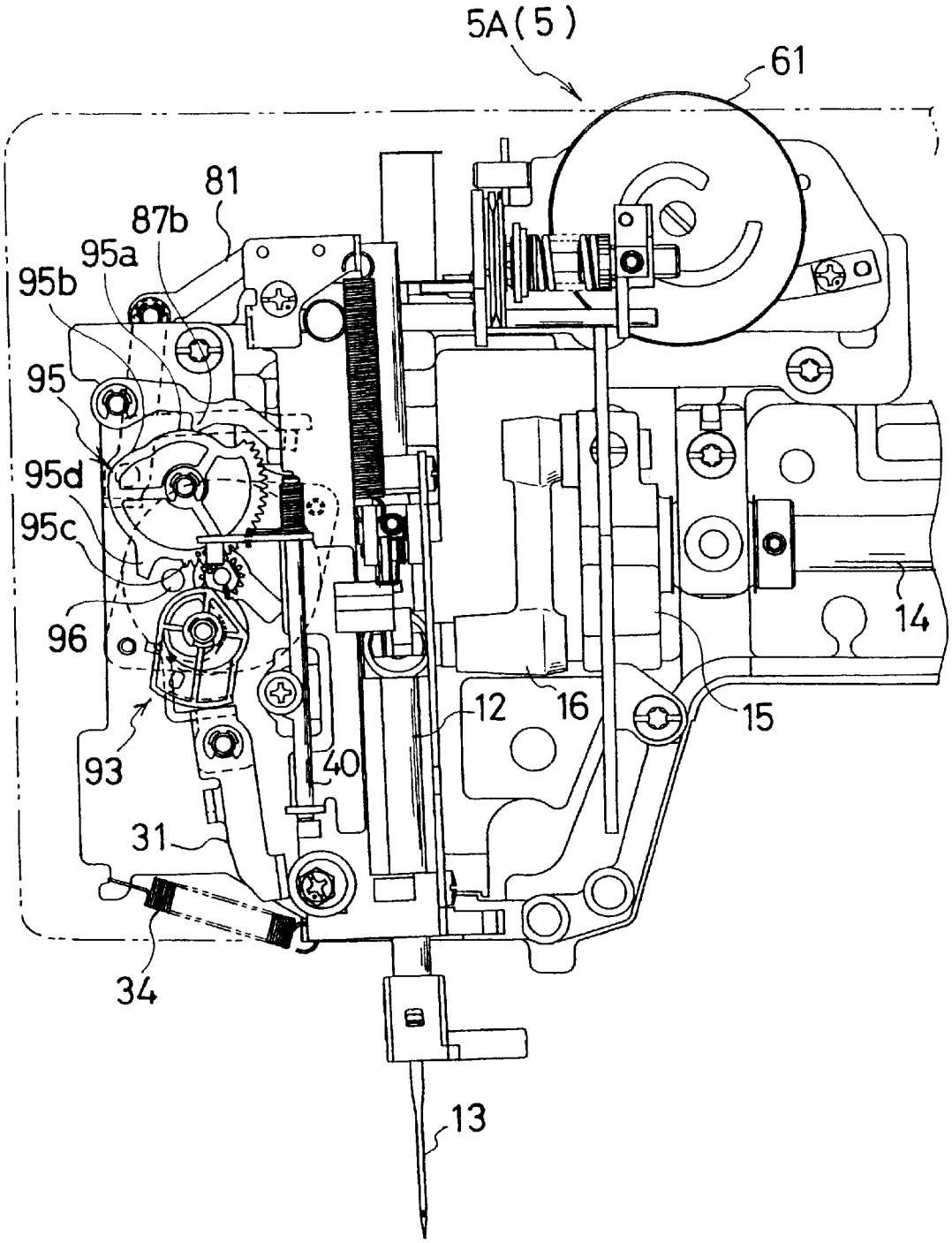
FIG. 11 corresponds to FIG. 1 when the phase angle is 30° at which the needle bar is moved to the furthest right.
Figure 12:
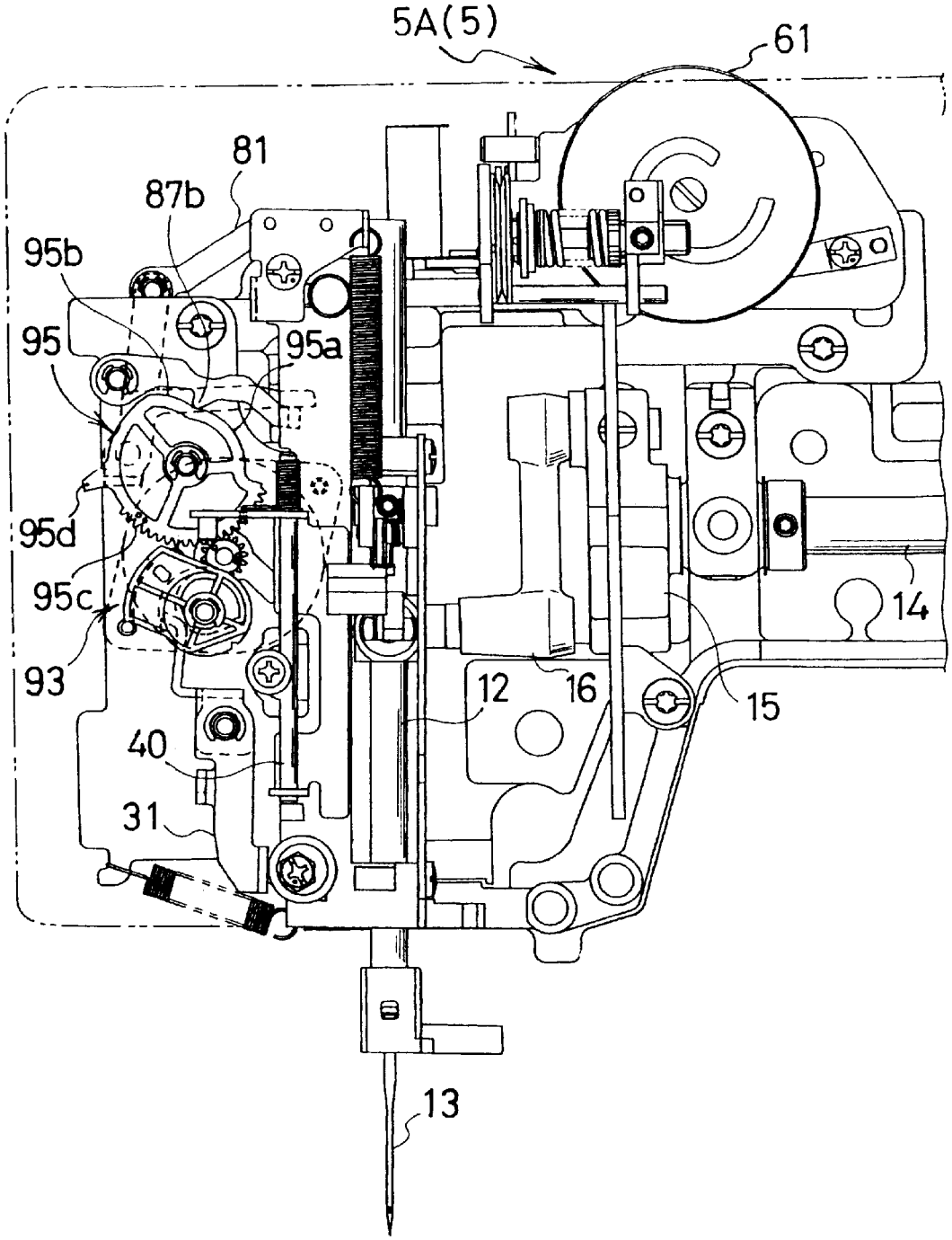
FIG. 12 corresponds to FIG. 1 when the phase angle is 240° at which the needle bar is moved to the furthest left.

When sewing is performed with this condition, the needle bar 12 is driven to move up and down, the electric motor 90 runs according to the oscillation width, to oscillate the needle bar 12, an optimum tension is applied to the needle thread 8, and fine stitches are sewn on a work cloth. FIG. 11 shows the needle bar 12 is at the extreme right end of its travel (approx. 30°), and FIG. 12 shows the needle bar 12 is at the extreme left end of its travel (approx. 240°).

Figure 15:
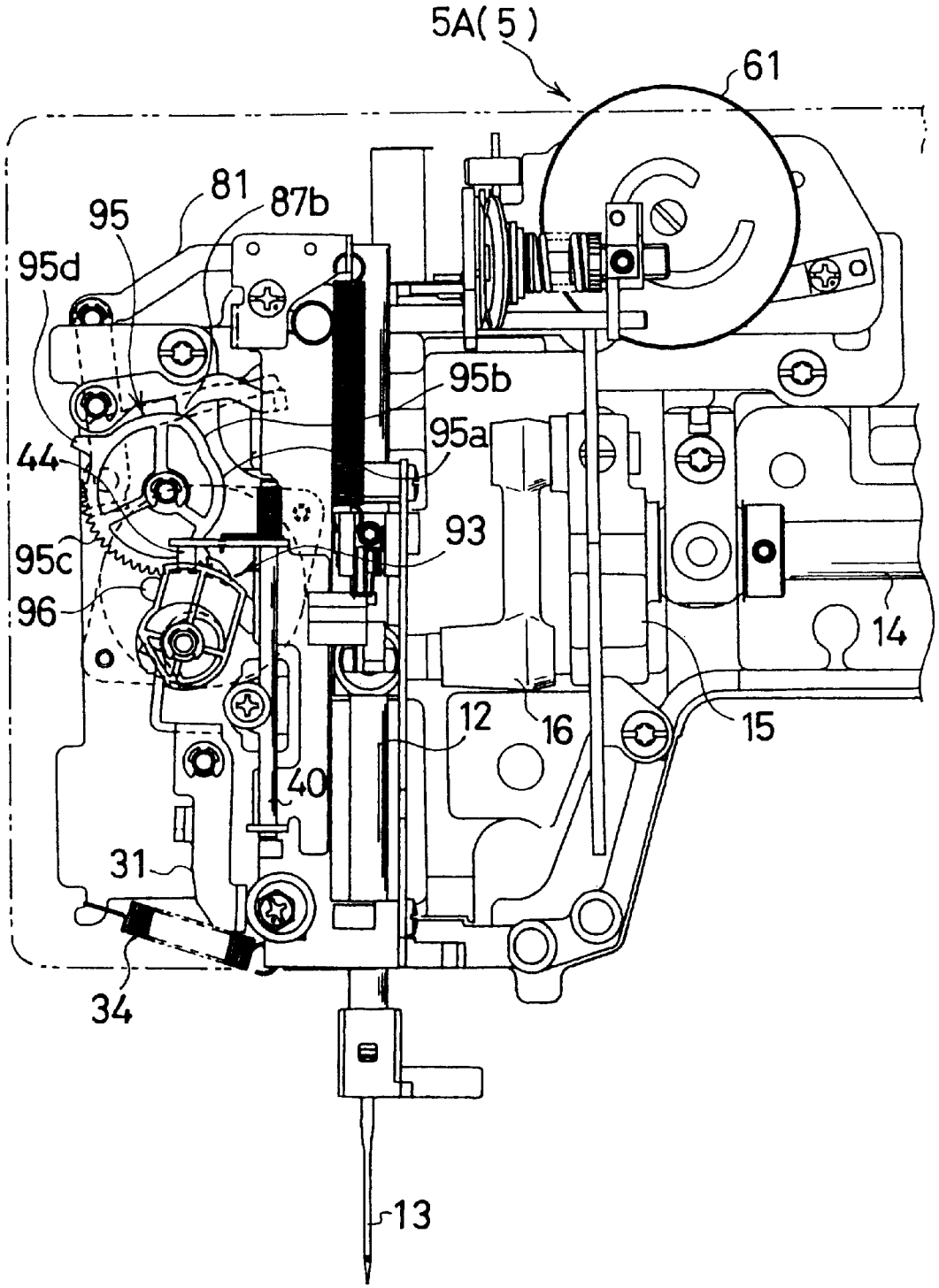
FIG. 15 corresponds to FIG. 1 when the phase angle is 405° at which a needle bar interrupting range is completed.

On the other hand, at the thread trimming at the end of sewing, the electric motor 90 is driven till its phase angle is approx. 240°, and then continuously driven till approx. 405° (FIG. 15). In other words, while the phase angle of the second cam 95 is between approx. 60° and approx. 86.25° (in the range where the needle thread tension is released), the contact part 87*b* of the third lever 87 moves along the tension releasing cam face 95*b*, and the first release lever 75 and the second release lever 76 are oscillated leftward via the link mechanism 80 as described above.

Figure 8:
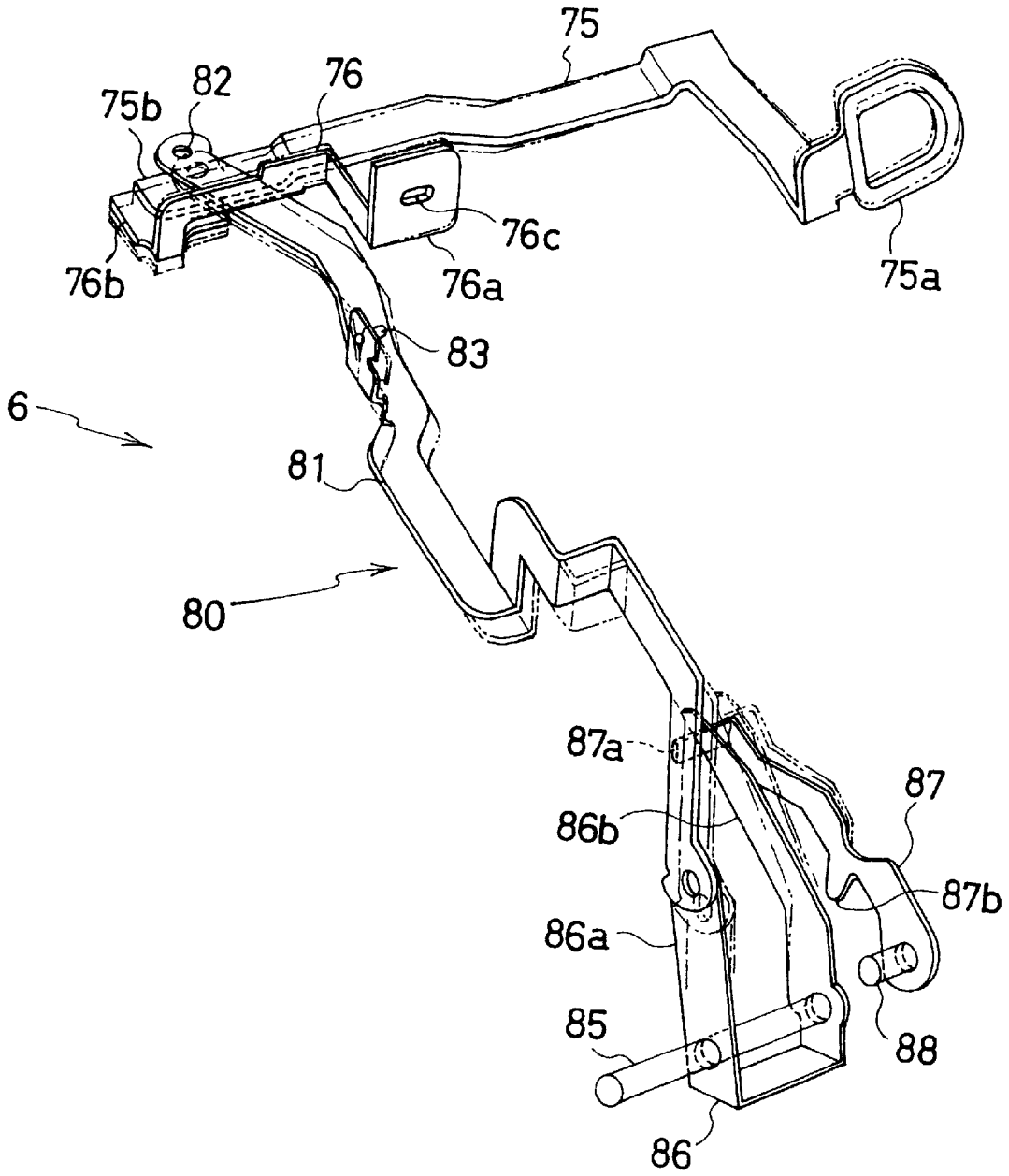
FIG. 8 is a schematic perspective view of a link mechanism of a tension releasing mechanism.
Figure 13:
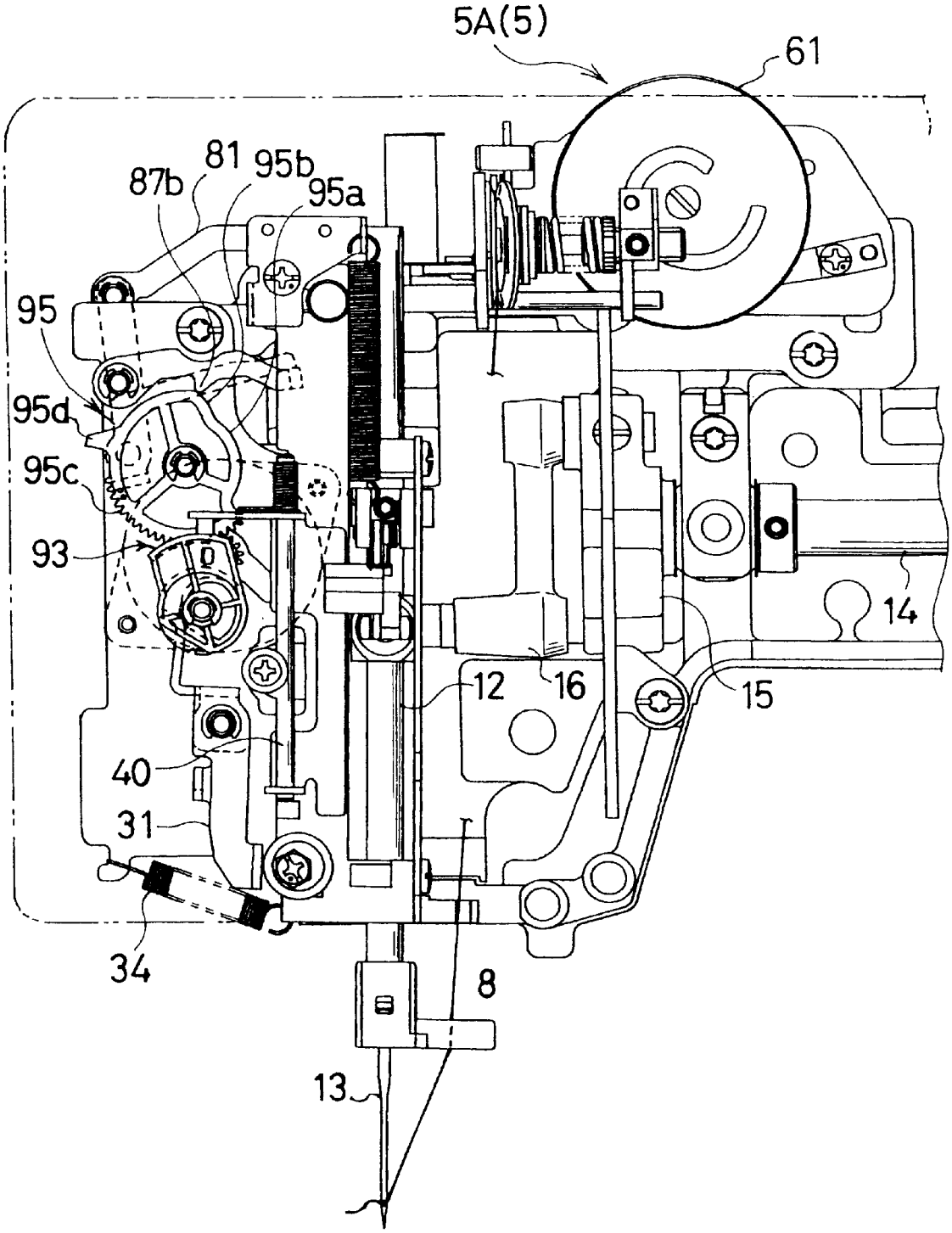
FIG. 13 corresponds to FIG. 1 when the phase angle is 345° at which a tension releasing range is completed.
Figure 14:
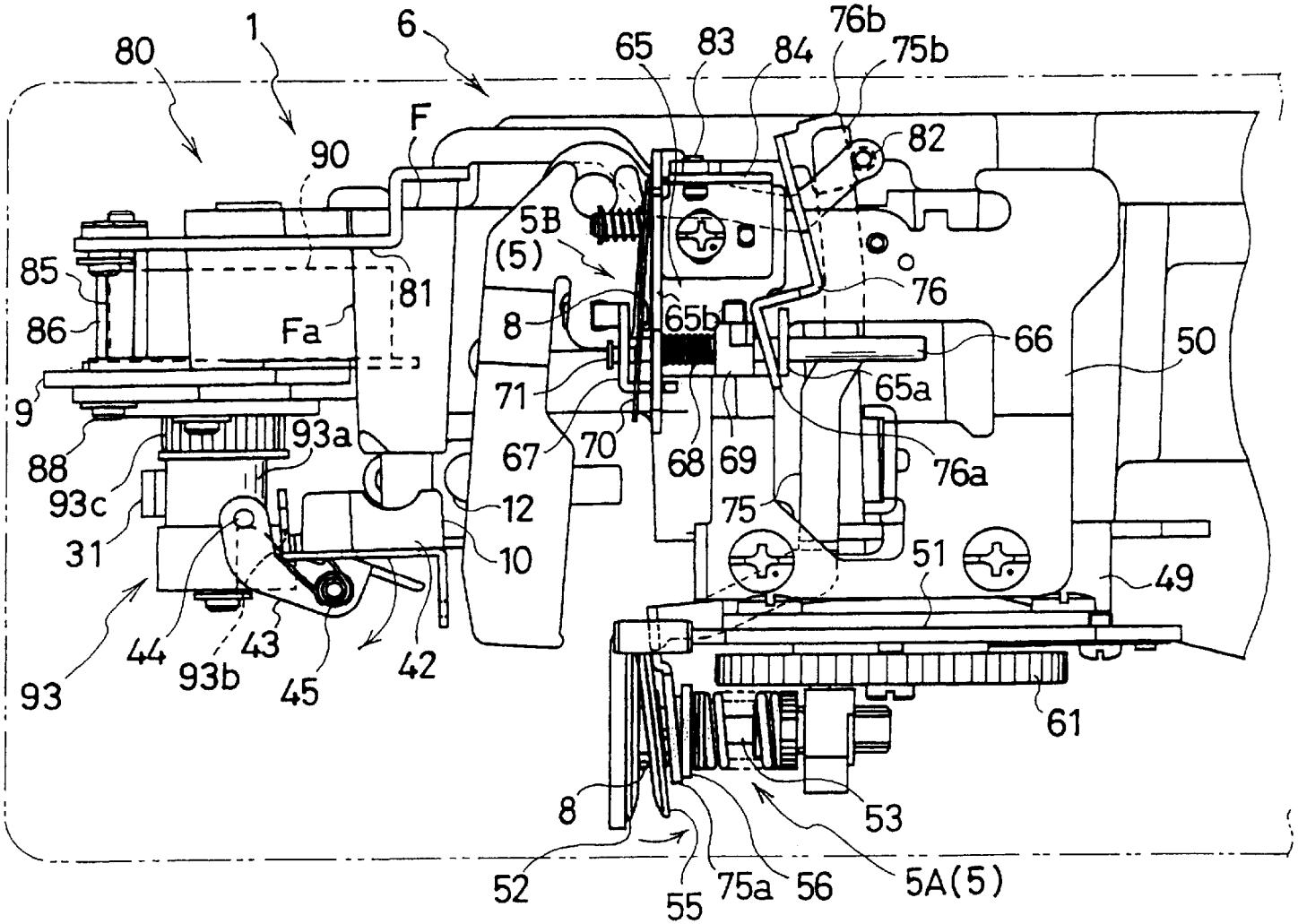
FIG. 14 corresponds to FIG. 3 when the tension releasing range is completed.

When the second cam 95 reaches the phase angle approx. 86.25° and has passed through the needle thread tension releasing range, as shown in FIGS. 8, 13 and 14, the first lever 81 moves leftward, oscillating the first release lever 75, the front end of the lever 75 moves the step ring 56 rightward via the action of a lever regarding the contact part of the rear of the part 75*a* and the movable thread tension disk 55 as a fulcrum, and the movable thread tension disk 55 is moved left from the fixed thread tension disk 52. This releases the tension applied to the needle thread 8 by the main thread tension mechanism 5A.

When the second release lever 76 oscillates, the contact part 76*a* moves the spring receiver 69 and the sub thread tension shaft 66 leftward via the action of a lever regarding the contact part between the front of the contact part 76*a* and the standing part 65*a* as a fulcrum. As shown in FIG. 14, the tension adjusting plate 70 also oscillates leftward, and the sub thread tension mechanism 5B releases the tension applied to the needle thread 8.

When the first cam 93 reaches the phase angle approx. 202.5° and has passed through the interrupting range where the needle bar is interrupted from moving up and down, as shown in FIGS. 15 and 16, the interrupting cam face 93*b* moves the pin 44 backward, to rotate the interruption plate 41 clockwise viewed from the top. The protrusion 20*a* of the oscillating member 40 comes off from the recess 17*a* of the needle bar connecting stud 17, the needle bar 12 is interrupted from moving up and down, and the needle bar 12 is slidably moved to its highest position and retained by the force of the extension coil spring 47.

Thus, the machine M provides the needle bar up/down moving mechanism 2, the needle bar oscillating mechanism 3, the needle bar interrupting mechanism 4, the thread tension adjusting mechanism 5, and the tension releasing mechanism 6. It further provides the driving mechanism 7 that uses the electric motor 90 to activate the needle bar oscillating mechanism 3, the needle bar interrupting mechanism 4, and the tension releasing mechanism 6. This means one output port is enough to provide in the output interface in the controller, resulting in reducing the size of the driving and control systems of the machine M and further simplifying the assembling operations.

The first cam 93, having the oscillating cam face 93*a* and the interrupting cam face 93*b*, is pivotally supported at the first pin 92 disposed on a lower position relative to the driving shaft connected to the electric motor 90. The second cam 95 having the tension releasing cam face 95*b* is pivotally supported at the second pin 94 disposed on an upper position relative to the driving shaft connected to the electric motor 90. The needle bar oscillating mechanism 3 is disposed on the comparatively low position, the needle bar interrupting mechanism 4 is disposed in the middle, and the tension releasing mechanism 6 is disposed on a comparatively high position close to the thread tension mechanism 5. The advantage is that the driving system operating the mechanisms 3, 4, 6 can be designed simply and in a small size.

Based on the standard phase angle of the electric motor 90 is 0°, the oscillating cam face 93*a*, the tension releasing cam face 95*b*, and the interrupting cam face 93*b* are arranged in such a manner that the needle bar oscillating range, the interruption range, and the needle thread tension releasing range are set in series. This arrangement enables the load on the electric motor 90 to be dispersed, making the size of the electric motor 90 small, and reducing the costs.

Modifications of the above embodiment will be described.

Based on the standard phase angle of the electric motor 90 is 0°, the interrupting cam face 93*b*, the tension releasing cam face 95*b*, and the oscillating cam face 93*a* can be arranged in such a manner that the interruption range, the needle thread tension releasing range, and the needle bar oscillating range are set in series. In addition, the interruption range and the needle thread tension releasing range can be set in parallel.

The interrupting cam face 93*b* can be provided in the second cam 95. The thread tension mechanism 5 can be comprised of only the main thread tension mechanism 5A. It can be arranged in such a manner that the amount of the needle thread can be controlled according to the rotation angle of the roller.

The electric motor 90 can be a motor that enables to control positioning such as a DC servomotor. The needle bar oscillating mechanism 3, the needle bar interrupting mechanism 4, and the tension releasing mechanism 6 are not limited to the illustrated embodiment. The mechanisms can work by an actuator, such as a solenoid, besides the electric motor 90.

The needle bar oscillating mechanism 3 can be replaced by the needle bar horizontal moving mechanism which is used in industrial sewing machines and moves the needle bar 12 in a predetermined horizontal direction.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. The invention may be further applied to various sewing machines, such as an embroidering machine and a sewing machine serving both sewing and embroidering, where an embroidery device is detachably attached.

What is claimed is:

1. A sewing machine, comprising:

a needle bar having a lower end to which a needle with an eye is attached;

a needle bar up/down moving mechanism that moves a needle bar up and down;

a needle bar oscillating mechanism that oscillates the needle bar in a lateral direction perpendicular to a feeding direction of a work cloth;

a needle bar interrupting mechanism that interrupts the needle bar up/down moving mechanism from moving the needle bar up and down;

a needle thread supply source that supplies a needle thread;

a thread tension adjusting mechanism that adjusts a tension of the needle thread in a path extending from the needle thread supplying source to the eye of the needle;

a tension releasing mechanism that allows the thread tension adjusting mechanism to release the tension of the needle thread;

an actuator that gives a driving force; and a driving mechanism that transmits the driving force of the actuator to the needle bar oscillating mechanism, the needle bar interrupting mechanism, and the tension releasing mechanism.

2. The sewing machine according to claim 1, wherein the actuator comprises an electric motor to which a driving shaft is connected.

3. The sewing machine according to claim 2, wherein the actuator comprises a stepping motor.

4. The sewing machine according to claim 2, wherein the driving mechanism comprises a first cam that controls the needle bar oscillating mechanism and the needle bar interrupting mechanism, and a second cam that controls the tension releasing mechanism, wherein the first and second cams are rotationally driven by the electric motor.

5. The sewing machine according to claim 4, wherein the first cam is pivotally mounted to a first pivot pin, which is parallel with the feeding direction of the work cloth and is disposed on a lower position relative to the driving shaft connected to the electric motor, and the second cam is pivotally mounted to a second pivot pin, which is parallel with the feeding direction of the work cloth and is disposed on an upper position relative to the driving shaft connected to the electric motor.

6. The sewing machine according to claim 5, wherein the first cam has an oscillating cam face that controls the needle bar oscillating mechanism and an interrupting cam face that controls the needle bar interrupting mechanism, and the second cam has a tension releasing cam face that controls the tension releasing mechanism.

7. The sewing machine according to claim 6, wherein the oscillating cam face, the tension releasing cam face, and the interrupting cam face are arranged based on the phase angle of the stepping motor, so that a needle bar oscillating range where the needle bar can be oscillated under control of the oscillating cam face, a tension releasing range where the tension of the needle thread is released under control of the tension releasing cam face, and a needle bar interrupting range where the needle bar up/down moving mechanism is interrupted from moving the needle bar up and down under control of the interrupting cam face are set in series.

8. A sewing machine, comprising:

a needle bar having a lower end to which a needle with an eye is attached;

a needle bar up/down moving mechanism that moves a needle bar up and down;

a needle bar horizontally moving mechanism that moves the needle bar in a predetermined horizontal direction;

a needle bar interrupting mechanism that interrupts the needle bar up/down moving mechanism from moving the needle bar up and down;

a needle thread supply source that supplies a needle thread;

a thread tension adjusting mechanism that adjusts a tension of the needle thread in a path extending from the needle thread supplying source to the eye of the needle;

a tension releasing mechanism that allows the thread tension mechanism to release the tension of the needle thread;

an actuator that gives a driving force; and a driving mechanism that transmits the driving force of the actuator to the needle bar horizontally moving mechanism, the needle bar interrupting mechanism, and the tension releasing mechanism.

9. The sewing machine according to claim 8, wherein the driving mechanism comprises:

a driving gear driven by the actuator;

a first cam having a gear engaged with the driving gear; and a second cam having a gear engaged with the driving gear.

10. The sewing mechanism according to claim 9, wherein the first cam has a neutral face section and a tension releasing cam face section, the tension releasing cam face section activating the tension releasing mechanism.

11. The sewing machine according to claim 9, wherein the second cam has an oscillating cam face that activates the needle bar horizontally moving mechanism and an interrupting cam face that activates the needle bar interrupting mechanism.

12. The sewing machine according to claim 10, wherein the second cam has an oscillating cam face that activates the needle bar horizontally moving mechanism and an interrupting cam face that activates the needle bar interrupting mechanism.

13. The sewing machine according to claim 9, wherein a gear ratio between the drive gear and the first cam is 1 to 4 and a gear ratio between the drive gear and the second cam is 1 to 2.

14. The sewing machine according to claim 12, wherein a gear ratio between the drive gear and the first cam is 1 to 4 and a gear ratio between the drive gear and the second cam is 1 to 2.

15. The sewing machine according to claim 12, wherein the oscillating cam face, the tension releasing cam face, and the interrupting cam face sequentially activate their respective means.

16. The sewing machine according to claim 14, wherein the oscillating cam face, the tension releasing cam face, and the interrupting cam face sequentially activate their respective means.

17. A sewing machine, comprising:

a needle bar having a lower end to which a needle with an eye is attached;

a needle bar up/down moving means for moving a needle bar up and down;

a needle bar oscillating means for oscillating the needle bar in a lateral direction perpendicular to a feeding direction of a work cloth;

a needle bar interrupting means for interrupting the needle bar up/down moving means from moving the needle bar up and down;

a needle thread supply source that supplies a needle thread;

a thread tension adjusting means for adjusting a tension of the needle thread in a path extending from the needle thread supplying source to the eye of the needle;

a tension releasing means for allowing the thread tension adjusting means to release the tension of the needle thread;

actuating means for giving a driving force; and driving means for transmitting the driving force of the actuating means to the needle bar oscillating means, the needle bar interrupting means, and the tension releasing means.

18. The sewing machine according to claim 17, wherein the driving means comprises:

a driving gear driven by the actuating means;

a first cam having a gear engaged with the driving gear; and a second cam having a gear engaged with the driving gear.

19. The sewing mechanism according to claim 18, wherein the first cam has a neutral face section and a tension releasing cam face section, the tension releasing cam section activating the tension releasing means, and the second cam has an oscillating cam face that activates the needle bar oscillating means and an interrupting cam face that activates the needle bar interrupting means.

20. The sewing machine according to claim 19, wherein the oscillating cam face, the tension releasing cam face, and the interrupting cam face sequentially activate their respective means.

* * * * *